United States Patent [19]

Monie

[11] Patent Number: 4,567,339

[45] Date of Patent: Jan. 28, 1986

[54] CAM OPERATED CONTROL DEVICE OF AN ELECTRICAL SWITCH

[75] Inventor: Jean Monie, Cluses, France

[73] Assignee: Societe Industrielle de Bellevaux, Sibel, Cluses, France

[21] Appl. No.: 628,338

[22] Filed: Jul. 6, 1984

[51] Int. Cl.[4] ..... H01H 19/62

[52] U.S. Cl. ..... 200/153 LB; 74/577 M

[58] Field of Search ..... 200/153 LB, 153 P; 74/577 S, 577 M

[56] References Cited

U.S. PATENT DOCUMENTS

| | | | |
|---|---|---|---|
| 3,156,123 | 11/1964 | Denny | 200/153 LB |
| 3,190,977 | 6/1965 | Harris | 200/153 LB |
| 3,257,535 | 6/1966 | Sallin et al. | 200/153 LB |
| 3,515,831 | 6/1970 | Church et al. | 200/153 LB |

*Primary Examiner*—Stephen Marcus
*Assistant Examiner*—Renee S. Kidorf
*Attorney, Agent, or Firm*—Robert E. Burns; Emmanuel J. Lobato; Bruce L. Adams

[57] ABSTRACT

The present invention relates to a control device incorporating at least one electrical switch which can be actuated abruptly, for closing and opening, by a single rotary control cam.

The control device incorporates a control cam 1 possessing a plurality of identical abrupt-drop notches 3 separated respectively by solid parts 4 identical to one another. A lever system is arranged between this cam 1 and the reversing switch 2. It comprises a first and a second lever 21 and 22 each of which pivots about a fixed axle 15 and the noses 31, 32 of which interact with the profile of the cam 1 under the action of a spring 8. A link 20 is articulated, on the one hand, at 21*a* on the first lever 21 and, on the other hand, at 22*a* on the second lever 22. It possesses a relief part 23 interacting with the reversing switch 22. When the nose 31 drops into a notch 3, with the nose 32 remaining on a solid part 4, the reversing switch is released, 6*a*–6*b* being closed and 6*c*–6*d* being open. When the nose 32 in turn drops into a notch 3, the reversing switch 2 is actuated abruptly, 6*a*–6*b* being opened and 6*c*–6*d* being closed. When the two noses 31, 32 climb approximately together along solid parts 4, the reversing switch 2 retains the preceding position up to the following drop of the nose 31 into a notch 3.

7 Claims, 4 Drawing Figures

CAM OPERATED CONTROL DEVICE OF AN ELECTRICAL SWITCH

FIELD OF INVENTION

The present invention relates to control devices incorporating at least one electrical switch which can be actuated abruptly, at closing and opening, by a single rotary control cam.

BACKGROUND OF THE INVENTION

In a known control device of this type, such as that described in French Pat. No. 2,249,425, the cam which is part of a timing mechanism is intended to actuate, once at each of its revolutions, a reversing switch which comprises three elastic conductive blades which are arranged side by side and are embedded at one end and which interact with the cam by means of their other respective ends supporting the actual contacts. Such a device has some disadvantages, particularly because of the presence of the elastic blades. In fact, since the respective ends of these blades support contacts interacting directly with the single notch of the control cam and since these blades work with a bending action, this results in a certain degree of inaccuracy as regards the actual moment of closing and opening of the switch, since, depending on whether the blades are more or less flexible because of their manufacture, they are capable of being actuated by the control cam at different moments. Moreover, since the profile of the cam is snail-shaped, the contacts, when in the closed position, constantly rub against one another during each revolution of the cam, thus causing permanent wear of the contacts and creating radio-electric disturbances. For the same reason, the contact pressure varies constantly during each revolution of the cam, the pressure being maximum when the blades rub against the highest part of the cam profile. Moreover, the blades actuate the contacts only once in each revolution of the control cam, and a complete revolution of the latter is necessary to bring the blades into the upper position ready to drop into the single notch again. This is a disadvantage when the said cam should be integral, for example, with a cam block designed to advance step by step and having a large number of steps per revolution, for example 60 steps. In fact, since the blades are flat up against the cam, it would be impossible to change the number of notches in such a proportion. Finally, to work correctly with a bending action, blades must have a relatively substantial length, and consequently the three blades described in the abovementioned patent have a relatively large bulk, and this prevents the possibility of certain uses of the control device of the prior art.

SUMMARY OF THE INVENTION

The control device which is the subject of the invention incorporates a control cam comprising a plurality of identical abrupt-drop notches which are separated respectively by solid parts identical to one another. It also possesses a lever system serving as an intermediary between the control cam and the switch. This lever system comprises a first and a second lever, each of which pivots about a fixed axle and each of which possesses a nose intended to interact under the action of at least one elastic means with the profile of the control cam. A link is articulated, on the one hand, on the first lever and, on the other hand, on the second lever at points separate from the fixed pivot axles of the said levers, one of these points of articulation sliding in the link or in the lever in question in a direction transverse to the direction of displacement of the noses of the two levers. The respective noses of the two levers have such dimensions and are positioned in such a way that the nose of the first lever can drop into any one notch of the control cam a moment before the nose of the second lever. The link possesses a relief part which is arranged opposite the switch and which has such dimensions and is positioned in such a way that it respectively opens and closes the switch abruptly when the nose of the first lever abruptly drops into any one of the notches, and that it respectively closes and opens the switch abruptly when the nose of the second lever abruptly drops into any one of the notches.

The present invention makes it possible to produce a control device which, whilst having a relatively reduced bulk is capable of actuating abruptly at least one electrical switch of any type, for closing and for opening, a large number of times during each revolution of its control cam, hence under the effect of a slight angular displacement of the latter, with a high degree of operating accuracy between the abrupt closing and abrupt opening of the switch for each angular displacement of the cam, whilst at the same time preventing any friction between the contacts and maintaining between them a substantially constant contact pressure when the said contacts are in the closed position.

BRIEF DESCRIPTION OF THE DRAWINGS

The attached drawing illustrates by way of example to embodiments of the control device according to the present invention.

As illustrated in FIGS. 1 to 3, the first embodiment of the control device incorporates a single rotary control cam 1 capable of being driven in rotation so as to actuate an electrical reversing switch 2.

Figure 1:
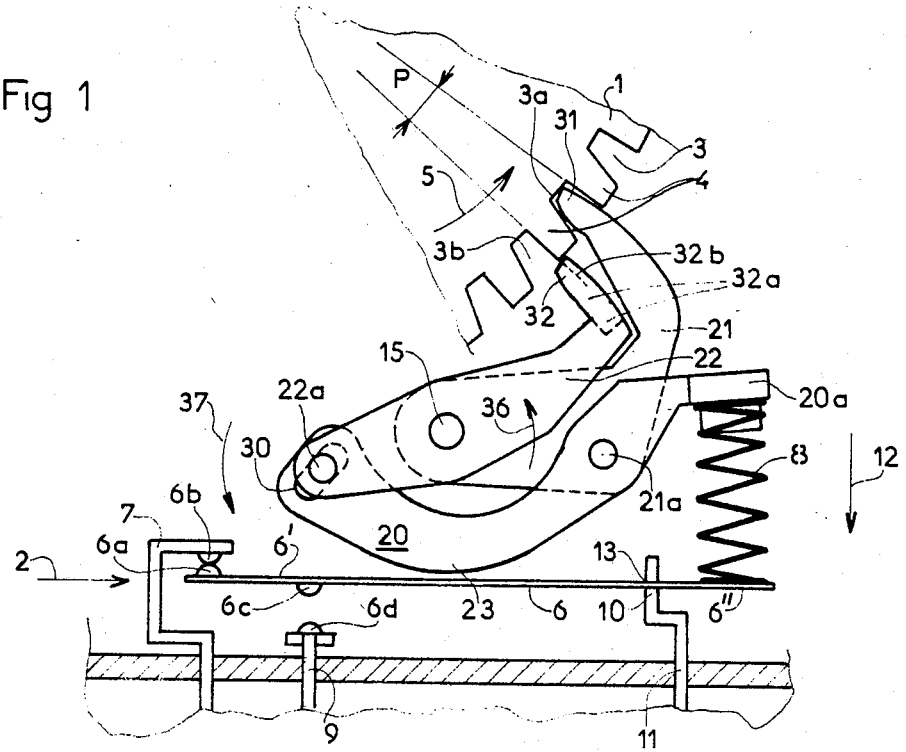
FIG. 1 is an schematic side elevation, partly in section, of a embodiment of an electrical switch control device in accordance with the invention.

The control cam which is, for example, a single-profile disk cam possesses on its periphery a plurality of identical abrupt-drop notches 3, 60 in this example, which are separated respectively by solid parts 4 identical to one another. In an appropriate application, the control cam 1 is, for example, integral with a program cam block, not shown in the drawing, which is intended to rotate step by step. The cam 1 being intended to rotate according to the arrow 5, each notch 3 and the following solid part 4 together correspond to an angular value P (FIG. 1) corresponding to an angular advance of the control cam 1 and the cam block of one step.

The reversing switch 2 consists of a contact-carrying blade 6 which is, for example, rigid and a first end 6' of which supports a first contact **6*a* designed to interact at rest, under the action of a compression spring 8 acting in the direction 12 on its second end 6'', with a fixed contact 6*b* integral with a contact holder 7. The first end 6' likewise supports a second contact 6*c* designed to interact against the action of the spring 8 with a fixed contact 6*c* integral with a contact holder 9, this second contact 6*c*** being oriented in the opposite direction to the contact 6a. The contact-carrying blade 6 is mounted pviotally by means of a central part 13 on a support 10 provided on a contact holder 11 which constitutes the common terminal of the reversing switch 2.

A lever system serves as an intermediary between the control cam 1 and the reversing switch 2. It comprises a first lever 21 and a second lever 22 which each pivot about a fixed axle. These levers are of course rigid. In the example, these two levers are pivoted about one and the same fixed axle 15. They each possess a nose 31 and 32 respectively, intended to interact with the profile of the control cam 1. In this embodiment, the noses 31 and 32 interact respectively with two separate notches 3 of the cam 1. The nose 32 of the second lever 22 possesses a lateral extension 32a (FIG. 1) which allows this nose 32 to interact with the cam 1 substantially in the same plane as the nose 31. This makes it possible for the control cam 1 to have a very small thickness, for example one millimeter, the bulk of the control device as a whole thus being reduced considerably in a direction parallel to the axis of rotation of the cam 1. The respective noses 31 and 32 of the levers 21 and 22 have such dimensions and are positioned in such a way that the nose 31 of the first lever 21 can drop into any one notch 3, for example 3a (FIG. 1), a moment before the nose 32 of the second lever 22 can drop into its own notch, for example into the adjacent notch 3b (FIG. 1). This delayed drop of the nose 32 is obtained by means of an extra thickness 32b provided on its rear flank. On the other hand, the noses 31 and 32 likewise have such dimensions and are positioned in such a way that that of the first lever can be actuated alone by the control cam 1 so as to escape from its notch 3a, after the noses of the two levers have dropped into their respective notches 3a, 3b (FIG. 1). For this purpose, the nose 31 of the first lever 21 possesses in relation to the nose 32 an extra thickness 31a (FIG. 2) on its front flank and on its end.

A link 20 is articulated, on the one hand, on the first lever 21 and, on the other hand, on the second lever 22 at points separate from the fixed pivot axle 15. In this embodiment, the link is articulated to the first lever 21 in a central part 21a of the latter and to the second lever 22 at a point 22a substantially opposite the nose 32 of the said second lever 22 in relation to the fixed axle 15. One of these points of articulation slides in the link 20 or in the lever in question 21 or 22 in a direction transverse to the displacement of the noses of the two levers. In this example, it is the point of articulation 22a, consisting of an axle integral with the second lever 22, which is mounted to slide in an oblong slot 30 of corresponding dimension, located in the link 20 transversely to the displacement of the noses 31, 32.

The link 20 possesses a relief part 23 which is arranged opposite the reversing switch 2 and which has such dimensions and is positioned in such a way that it abruptly opens the switch 6a–6b and closes the switch 6c–6d when the nose 31 of the first lever 21 abruptly drops into any one of the notches 3, and that it abruptly closes the switch 6a–6b and opens the switch 6c–6d when the nose 32 of the second lever 22 abruptly drops into any one of the notches 3. In this example, the relief part 23 of the link 20 has a profile at least approximately concentric relative to the fixed axle 15 common to the two levers 21 and 22. The link 20 possesses an extension 20a located opposite the slot 30 in relation to the point of articulation 21a. This extension 20a serves as a support for the second end of the spring 8, a compression spring in this example, the first end of which bears on a second end 6″ of the blade 6. The respective noses of the two levers 21 and 22 thus interact with the profile of the control cam 1 under the action of a single elastic means 8 located between the part 20a of the link 20 and a point 6″ of the control device which is substantially fixed since the displacement of the end 6″ of the blade 6 is extremely reduced.

In this example, at the end of the angular advance of the control cam 1 by one step, the various component elements occupy the position illustrated in FIG. 1. The first nose 31 has just dropped into the notch 3a, the second nose 32 is retained against the following solid part 4 because of its rear extra thickness 32b, and the relief part 23 of the link 20 is not up against the rigid blade 6, the switch 6a–6b thus being closed under the action of the spring 8 and the switch 6c–6d being open. This spring 8 tends to make the nose 31 interact with the cam 1 by causing the point of articulation 21a of the link 20 to pivot in the direction 36. It also tends to make the nose 32 interact with the cam 1 by causing the point of articulation 22a to pivot in the direction 37.

Figure 2:
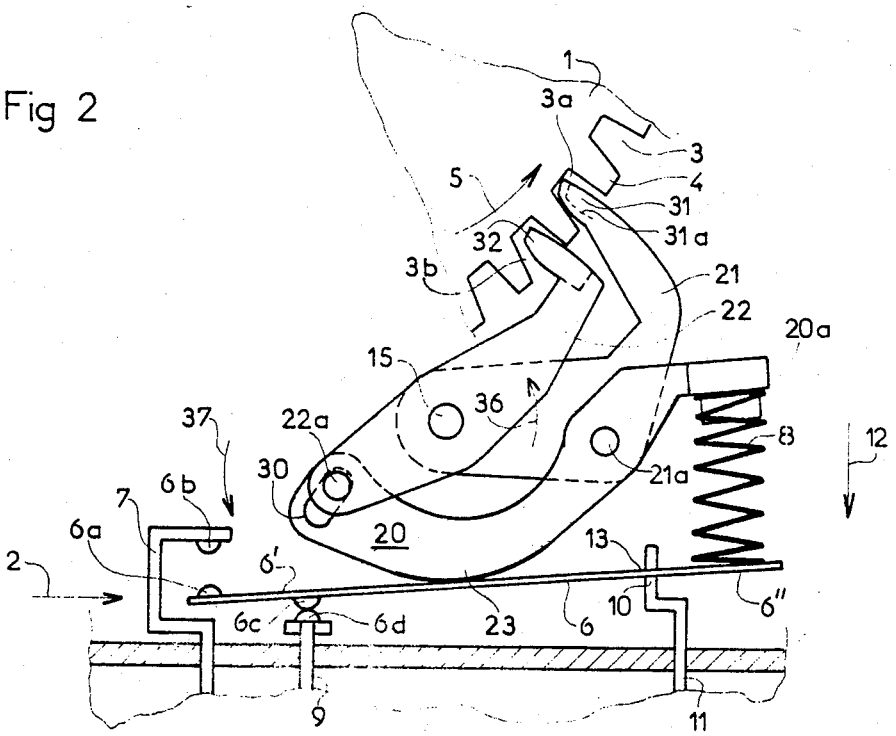
FIGS. 2 and 3 are schematic side elevations partly in section showing the switch control device in successive phases of operation, and, FIG. 4 is a schematic side elevation, partly in section of a second embodiment.

After a subsequent slight angular displacement of the control cam 1, the nose 32 of the second lever 22 initially drops, in turn, into its notch 3b, without its end touching the bottom of the said notch 3b, as shown in FIG. 2, the nose 31 of the first lever 21 remaining up against the bottom of the notch 3a. At the same time, the point of articulation 22a rotates about the fixed axle 15 in the direction 37, thus displacing the relief part 23 in the direction of the rigid blade 6 and abruptly closing the switch 6c–6d, simultaneously opening the switch 6a–6b (FIG. 2) abruptly against the action of the spring 8, the contact pressure being determined solely by the pressure of this spring 8.

Figure 3:
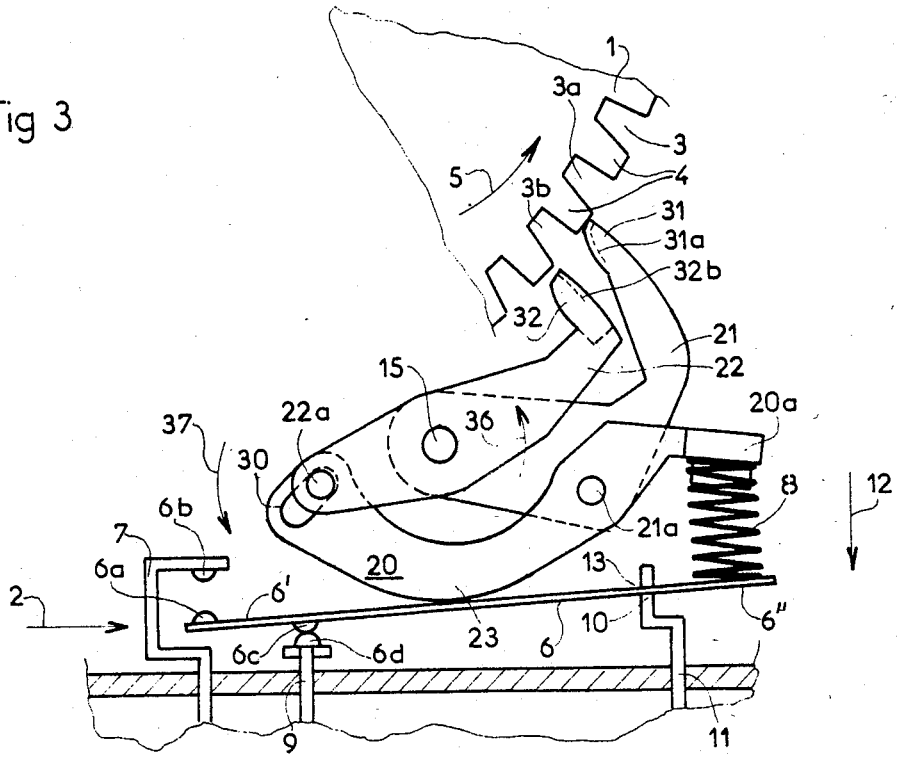

At the following moment (FIG. 3), the nose 31 of the first lever 21 is brought onto the upper level of the following solid part 4, the point of articulation 21a pivoting at the same time in the opposite direction to 36 and the point of articulation 22a pivoting in the opposite direction to 37, during which time the nose 32 of the second lever 22 consequently escapes from its notch 3b without touching the flanks of the latter. The relief part 23 thus pivots about the fixed axle 15 and slides slightly against the blade 6, maintaining the two switches constantly in their preceding positions (FIG. 2).

As soon as the cam 1 has completed its rotation through an angle P, the nose 31 of the first lever 21 drops into the notch 3b, the switch 6c–6d opens abruptly and the switch 6a–6b closes abruptly, and so on and so forth.

Figure 4:
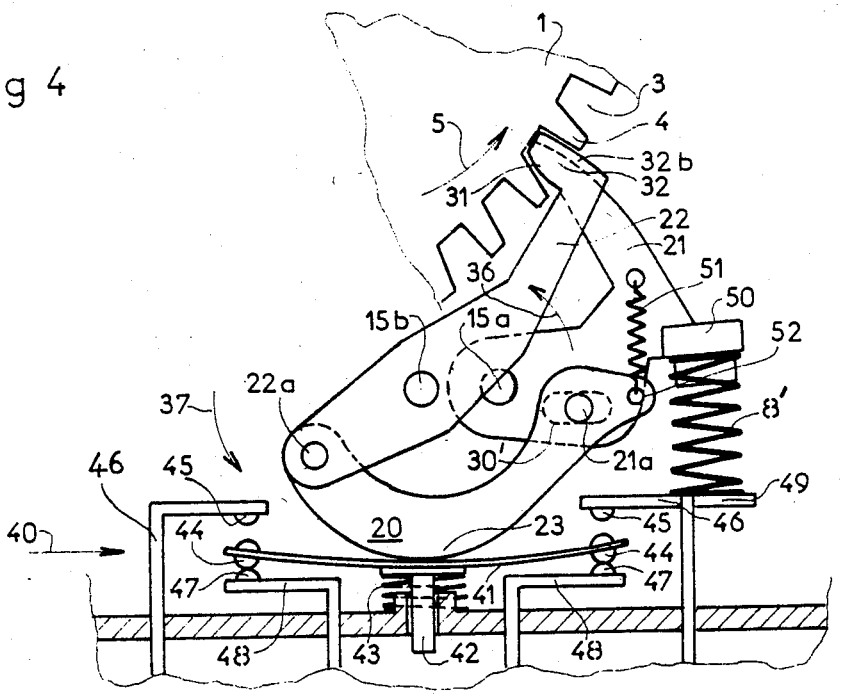

Without departing from the scope of the present invention, it is possible to provide a certain number of alternative forms for certain parts of the control device, some of which have been brought together in FIG. 4, although these parts can be used in various combinations.

Thus, in the second embodiment illustrated by way of example in FIG. 4, the first and second levers 21 and 22 are no longer pivoted about a single fixed axle, but about two separate fixed axles 15a and 15b respectively, and the point of articulation 21a consisting of an axle integral with the link 20 is mounted to slide in an oblong slot 30′ of corresponding dimension, this slot being provided in the first lever 21 transversely to the displacement of the noses 31, 32. The noses 31 and 32 of the two levers 21 and 22 interact at the same time with a single notch 3, the first nose no longer having its extra thickness at the front and end 31a. Thus, in the intermediate position of FIG. 4, similar to that of FIG. 2 of the first embodiment, the respective noses of the two levers have such dimensions and are positioned in such a way that both can be actuated at the same time by the control cam 1, so as to escape from their notch 3 at the same time, after the noses of the two levers 21, 22 have dropped into this notch 3 one after the other.

On the other hand, the reversing switch 2 is omitted, for example, and replaced by a reversing switch 40 comprising a flexible blade 41, the transverse supporting axle 42 of which is displaceable along a rectilinear path. Under the action of a spring 43, two double contacts 44 supported by the blade 41 constantly tend to come up against contacts 45 supported by contact holders 46. Against the action of the spring 43, the double contacts 44 are capable of interacting with contacts 47 supported by contact holders 48. The spring 8′ does not play any part in the reversing switch 40. It bears, on the one hand, against a fixed point 49 and, on the other hand, against an extension 50 of the first lever 21, and it pushes only the corresponding nose 31 against the cam 1 in the direction 36. Another spring 51, for example working as a draw spring, connects an extension 52, replacing the abovementioned extension 20*a* (FIGS. 1 to 3) to part of the first lever 21 in such a direction that the point of articulation 22*a* of the second lever 22 tends to pivot about the fixed axle 15*b* in the direction 37, keeping the nose 32 of the second lever 22 constantly up against the profile of the cam 1.

All the other component elements are identical to those of the first embodiment described above (FIGS. 1 to 3). The mode of operation of the device as a whole is similar.

When the nose 31 is in a notch 3 and the nose 32 is up against a solid part 4, in a position similar to that of FIG. 1, the relief part 23 is not up against the blade 41.

As soon as the nose 22 drops, in turn, into the notch 3 in the position illustrated in FIG. 4, the point of articulation 22*a* pivots about the fixed axle 15*b* in the direction 37, the relief part 23 pivoting about the axle 21*a* ano pushing back the blade 41. The switch 44–45 is thus opened and the switch 44–47 closed, the relief part 23 keeping the blade 41 bent (FIG. 4).

Subsequently, the two noses 31 and 32 are pushed back at the same time by the cam 1 onto the following solid part 4, the point of articulation 21*a* being displaced in the opposite direction to 36 about the fixed axle 15*a* and the point of articulation 22*a* being displaced in the opposite direction to 37 about the fixed axle 15*b*. The contact pressure exerted by the relief part 23 remains substantially constant, until the nose 31 of the first lever 21 drops into a new notch 3, the switch 44–47 consequently being opened abruptly and the switch 44–45 closed abruptly.

Control devices such as those described above have additional advantages when, as indicated above, the control cam 1 is actuated step by step by means of an electric motor. In fact, as soon as the angular displacement P of the cam 1, corresponding to one step, has started, the nose 32 of the second lever 22 closes the switch 6*c*–6*d* (FIGS. 1 to 3) or 44–47 (FIG. 4), which is connected in such a way that in this position it supplies the electric motor directly. It is thus guaranteed that the cam 1 and the program cam block integral with it will with absolute certainty be driven in rotation up to the end of the step in progress.

I claim:

1. A control device incorporating at least one electrical switch (2; 40) which can be actuated abruptly, for closing and opening, by a single rotary control cam (1), the said device incorporating a control cam (1) comprising a plurality of identical abrupt-drop notches (3) separated respectively by solid parts (4) identical to one another, and a lever system serving as an intermediary between the control cam (1) and the switch and comprising a first and a second lever (21, 22), each of which pivots about a fixed axle (15; 15*a*, 15*b*) and each of which possesses a nose (31, 32) intended to interact under the action of at least one elastic means (8; 8′, 51) with the profile of the control cam (1), a link (20) being articulated, on the first lever (21) and, on the second lever (22) at points (21*a*, 22*a*) separate from the fixed pivot axles of the said levers, one of these points of articulation sliding in the link or in the respective lever in a direction transverse to the direction of displacement of the noses of the two levers, the respective noses (31, 32) of the two levers (21, 22) having such dimensions and positioned in such a way that the nose (31) of the first lever can drop into any one notch (3) of the control cam (1) a moment before the nose (32) of the second lever, said link (20) possessing a relief part (23) which is arranged opposite the switch and which has such dimensions and is positioned in such a way that it respectively opens and closes the switch abruptly when the nose (31) of the first lever abruptly drops into any one of the notches (3), and that it respectively closes and opens the switch abruptly when the nose (32) of the second lever abruptly drops into any one of the notches (3).

2. A control device as claimed in claim 1, wherein the respective noses (31, 32) of the two levers (21, 22) have such dimensions and are positioned in such a way that the nose of the first lever can be actuated alone by the control cam (1), so as to escape from its notch (3) after the noses of the two levers have dropped into a notch (3).

3. A control device as claimed in claim 1, wherein the respective noses (31, 32) of the two levers (21, 22) have such dimensions and are positioned in such a way that both can be actuated at the same time by the control cam (1), so as to escape from their notch (3) at the same time after the noses of the two levers have dropped into a notch (3).

4. A control device as claimed in claim 1, wherein the two levers (21, 22) are pivoted about one and the same fixed axle (15), said link (20) being articulated to the first lever (21) in a central part (21*a*) of the latter and to the second lever (22) at a point (22*a*) substantially opposite the nose (32) of the said second lever (22) in relation to the fixed axle (15).

5. A control device as claimed in claim 4, wherein the relief part (23) of the link (20), arranged opposite the switch (2), has a profile at least approximately concentric relative to the fixed axle (15) common to the two levers.

6. A control device as claimed in claim 1, wherein the respective noses of the two levers interact with two separate notches (3*a*, 3*b*) of the control cam (1).

7. A control device as claimed in claim 1, wherein the respective noses (31, 32) of the two levers interact with the profile of the control cam (1) under the action of a single elastic means (8) located between a part (20*a*) of said link (20) and a substantially fixed point (6″) of the control device.

* * * * *